US006988529B2

(12) United States Patent
Sterling

(10) Patent No.: US 6,988,529 B2
(45) Date of Patent: Jan. 24, 2006

(54) METHOD AND APPARATUS FOR PREPARING A METAL OR METAL-ALLOY PRODUCT FOR A CASTING PROCESS

(76) Inventor: Evgenij Sterling, Katharinenstrasse 62/1, 73728 Esslingen (DE)

( * ) Notice: Subject to any disclaimer, the term of this patent is extended or adjusted under 35 U.S.C. 154(b) by 0 days.

(21) Appl. No.: 10/386,587

(22) Filed: Mar. 12, 2003

(65) Prior Publication Data

US 2004/0003912 A1 Jan. 8, 2004

(30) Foreign Application Priority Data

Mar. 13, 2002 (DE) ..... 102 12 349

(51) Int. Cl.

| | |
|---|---|
| ***B22D 27/00*** | (2006.01) |
| ***B22D 27/02*** | (2006.01) |
| ***B22D 23/00*** | (2006.01) |
| ***B22D 25/00*** | (2006.01) |
| ***B22D 17/08*** | (2006.01) |

(52) U.S. Cl. ..... 164/57.1; 164/113; 164/468; 164/469; 164/495; 164/499

(58) Field of Classification Search ..... 164/900, 164/113, 71.1, 55.1, 57.1, 58.1, 337, 437, 164/468, 504, 147.1, 469, 495, 498–499, 164/508, 514

See application file for complete search history.

(56) References Cited

U.S. PATENT DOCUMENTS

| | | | | |
|---|---|---|---|---|
| 3,813,469 A | * | 5/1974 | Eguchi et al. | 373/19 |
| 4,023,783 A | * | 5/1977 | Moreau | 266/208 |
| 4,108,643 A | * | 8/1978 | Flemings et al. | 148/400 |
| 4,875,519 A | * | 10/1989 | Ishii et al. | 164/465 |
| 5,178,204 A | | 1/1993 | Kelly et al. | 164/468 |
| 5,379,828 A | | 1/1995 | Blazek et al. | 164/459 |
| 5,494,095 A | | 2/1996 | Blazek et al. | 164/418 |
| 2002/0179280 A1 | * | 12/2002 | Peleschka et al. | 164/499 |

FOREIGN PATENT DOCUMENTS

| | | | |
|---|---|---|---|
| DE | 100 02 670 A1 | | 8/2001 |
| JP | 57-32859 | * | 2/1982 |
| JP | 57-127555 | * | 8/1982 |
| JP | 1-309766 | * | 12/1989 |

OTHER PUBLICATIONS

J.-P. Gabathuler and J. Erling, "Thixocasting: ein modernes Verfahren zur Herstellung von Formbauteilen" [Thixocasting: A Modern Method for Producing Molded Components], published in the proceedings of "Aluminium als Leichtbaustoff in Transport and Verkehr" [Aluminum as a Light Building Material for Transporting und Traffic], pp. 63-77 (ETH Zürich, May 27, 1994).

Patent Abstracts of Japan No. 01306047 A, Dec. 11, 1989.

Patent Abstracts of Japan No. 08290257 A, Nov. 5, 1996.

European Search Report.

* cited by examiner

*Primary Examiner*—Kuang Y. Lin
(74) *Attorney, Agent, or Firm*—Kennedy Covington Lobdell & Hickman, LLP

(57) ABSTRACT

The present invention relates to a method and apparatus for preparing a metal or metal-alloy product for a casting process—wherein the product is brought into a partly solidified (semi-solidified) state before casting—in which the product contains crystallization nuclei uniformly distributed throughout its volume. The method involves introducing an amount of a chosen alloy (in pulverized form) and an amount of a chosen melt, which is at a temperature above the liquefaction temperature of the alloy, into a crystallization vessel, which is heated to below the liquefaction temperature of the alloy, and mixing the melt and the alloy together in the crystallization vessel by means of electrical and/or magnetic forces to create the desired product.

14 Claims, 4 Drawing Sheets

METHOD AND APPARATUS FOR PREPARING A METAL OR METAL-ALLOY PRODUCT FOR A CASTING PROCESS

CROSS-REFERENCES TO RELATED APPLICATIONS

This application claims the benefit of German patent application 10212349.7 filed Mar. 13, 2002, incorporated herein by reference.

FIELD OF THE INVENTION

The present invention relates to a method and apparatus for preparing a metal or metal-alloy product for a casting process—wherein the product is brought into a partly solidified (semi-solidified) state before casting—in which the product contains crystallization nuclei uniformly distributed throughout its volume.

BACKGROUND

The production of semi-solidified metal or metal-alloy products is known, for example, from an article by J. -P. Gabathuler and J. Erling, entitled "Thixocasting: ein modernes Verfahren zur Herstellung von Formbauteilen" [Thixocasting: A Modem Method for Producing Molded Components], which was published in the proceedings of "Aluminium als Leichtbaustoff in Transport und Verkehr" [Aluminum as a Light Building Material for Transporting and Traffic], pages 63–77 (ETH Zürich, May 27, 1994).

SUMMARY OF THE INVENTION

An object of the present invention is to prepare a metal or metal-alloy product from a metal or metal alloy carrier material (hereinafter referred to as "melt") and an alloy, the product having a homogeneous distribution of crystallization nuclei throughout its volume at a point prior to the product being introduced into a mold during the casting process.

The present invention achieves this object by introducing an amount of a chosen alloy (in pulverized form) and an amount of a chosen melt, which is at a temperature above the liquefaction temperature of the alloy, into a crystallization vessel, which is heated to below the liquefaction temperature of the alloy, and mixing the melt and the alloy together in the crystallization vessel by means of electrical and/or magnetic forces to create the desired product.

During the introduction of the alloy and the melt into the crystallization vessel, the pulverized particles of the alloy, which preferably is in a powdered form, are immediately enclosed by the melt to form crystallization nuclei, which are then homogeneously distributed within the subsequent mixture by means of the electrical and/or magnetic forces to form the product.

In another embodiment of the present invention, the melt is introduced into the crystallization vessel in the form of a stream flowing between two electrodes, which are supplied with an electrical voltage. The resulting stream is narrowed, based on the so-called pinch effect, compressed and is already partially split into individual liquid drops as the melt flows into the crystallization vessel. Thus, the crystallization vessel is not filled by means of compact and separate streams (one of melt and one of alloy), but rather by a dispersed stream in which the melt and alloy are partially intermingled. Such a dispersal means that the surface area of the resulting stream is clearly increased, so that degassing also occurs.

After the melt has completely flowed into the crystallization vessel, the melt stream disappears so that the flow of the dispersed product stream is also interrupted. For achieving further dispersion, and also for creating an electrical field, an electrical arc is established between the product and an electrode within the crystallization vessel after the introduction of the alloy and the melt into the crystallization vessel.

A magnetic field may be generated in the crystallization vessel to promote additional mixing of the product contained therein, and to improve the uniformity of the distribution of the crystallization nuclei therein. The magnetic field and the electrical field act in different ways on the product, and the particles contained therein, so that the mixing effect is enhanced.

In another embodiment of the present invention, the melt flows into the crystallization vessel, to which a vacuum has been applied. By creating a vacuum in the crystallization vessel, the dispersed melt stream is further dispersed into individual drops, increasing the mixing of the alloy with the melt and, thus promoting the formation of crystallization nuclei within the product.

In a further embodiment of the invention, a protective gas is added to the melt as it is being fed into the crystallization vessel. In particular, the process is further improved if the protective gas is supplied under pressure. The introduction of the protective gas prevents chemical reactions of the alloy with the atmosphere, which could negatively affect any subsequent casting process using the product.

In an apparatus for performing the method, a crystallization vessel with an inlet for melt and an inlet for alloy in powder form is provided. The crystallization vessel includes a heating arrangement and is provided in the area of its bottom and its melt inlet with electrodes connected to a voltage source.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
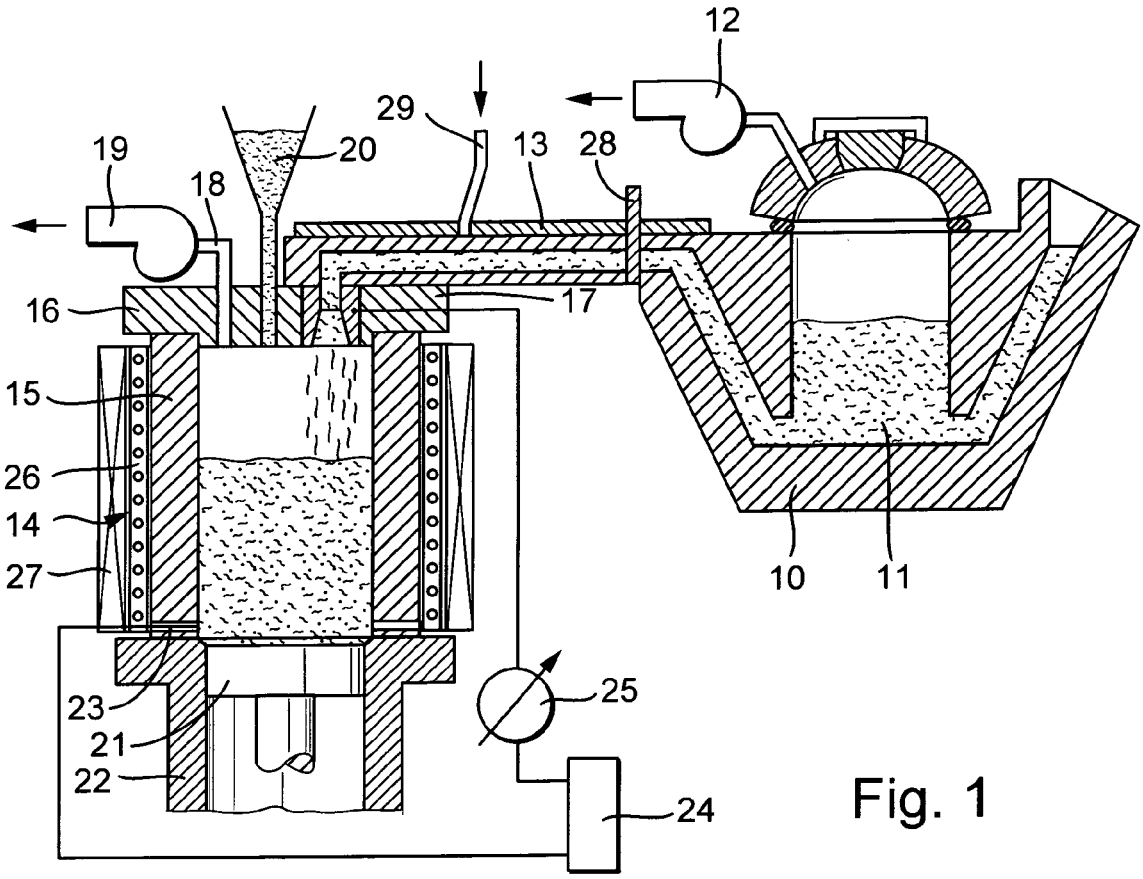
FIG. 1 is a cross-sectional view, of a schematic representation of the present invention, illustrating the connection between the crystallization vessel and the furnace.

Now referring to FIG. 1, in a furnace 10 a melt 11 of a metal alloy, for example AISI 9, is maintained at a temperature greater than the liquefaction temperature of the particular alloy. The furnace 10 is maintained at a vacuum by means of an exhaust device 12.

The furnace 10 is connected to the crystallization vessel 14 by a casting conduit 13. The crystallization vessel 14 includes a cylinder 15 made of an electrically non-conducting material that has a heat conducting capability between 0.20 and 1.5 W/mk. A cover 16, made of an electrically nonconductive material, closes the top of the cylinder 15. The casting conduit 13 is connected to the cover 16. Preferably, a melt inlet element 17 extends from the casting conduit 13 through the cover 16 to allow the melt 11 to flow into the crystallization vessel 14. The melt inlet element 17 has a conically widening inlet opening and is made of an electrically conductive material. A vacuum line 18 is connected to the cover 16 to provide communication between the crystallization vessel 14 and a suction removal device 19, so that a vacuum may be created within the crystallization vessel 14. The cover 16 is also provided with a filler neck 20, through which alloy in powder form can be introduced into the crystallization vessel 14. A piston 21, also made of an electrically nonconducting material, is movably inserted into a bottom of the cylinder 15 to seal a bottom of the crystallization vessel 14. The cylinder 15, the cover 16 and the piston 21 form a chamber for mixing the melt and the alloy into the product. The piston 21 travels within a guide cylinder 22 which is connected to the crystallization vessel 14. A product outlet port (not shown) is integral to the guide cylinder 22 and is used to affect the removal of the product from the crystallization vessel 14.

A heating device 26 is arranged about the crystallization vessel 14, to selectively heat and maintain the crystallization vessel 14 at a pre-selected temperature. Preferably, the heating device 26 is electrical and is adjustable. A magnetic coil 27 is arranged about the crystallization vessel 14. The magnetic coil 27 preferably generates an adjustable magnetic field in the chamber defined by the cylinder 15, the cover 16 and the piston 21 inside the crystallization vessel 14.

A gate slide 28 is disposed within the casting conduit 13 to regulate flow of the melt from the furnace 10 to the crystallization vessel 14. A gas supply line 29 is connected to the casting conduit 13, through which a protective gas, for example argon, can be supplied to a melt stream flowing through the casting conduit 13. Preferably, the protective gas is supplied under overpressure.

In a preferred embodiment, an electrode 23 is disposed on an interior of the cylinder 15, preferably near the bottom of the cylinder 15 of the crystallization vessel 14. As already mentioned, the melt inlet element 17 is made of an electrically conducting material. A voltage source 24 is connected to the electrode 23 and the melt inlet element 17 to provide electrical power to both. Preferably, the voltage source 24 is adjustable, in particular its current strength, by an adjustment device 25.

The product is prepared by the method discussed as follows. The furnace 10 is maintained at a vacuum by operation of the exhaust device 12. Preferably, the furnace 10 is maintained at a vacuum between about 0.5 mbar and 3 mbar. The melt within the furnace 10 is maintained at a temperature greater than the liquefaction temperature of the alloy.

The crystallization vessel 14 is heated to a temperature less than the liquefaction temperature of the alloy by selectively controlling the heating device 26 attached thereto. Preferably, the crystallization vessel 14 is maintained at a temperature which is about 3% to 50% lower than the liquefaction temperature of the respective alloy. The suction removal device 19 attached to the crystallization vessel 14 by the vacuum line 18 creates and maintains a vacuum within the crystallization vessel 14. Preferably, the vacuum in the crystallization vessel 14 is greater than the vacuum maintained in the furnace 10 to promote the flowing of the melt from the furnace 10 into the crystallization vessel 14.

Upon opening of the slide gate 28, the melt 11 within the furnace 10 flows into the crystallization vessel 14. Protective gas is supplied to the aspirating melt by the gas supply line 29. The vacuum created within the crystallization vessel 14 causes the alloy powder to be dispensed into the crystallization vessel 14 through the filler neck 20. The dispensed alloy powder is thus combined with the melt and is distributed therethrough to form the product.

A voltage is applied to the electrode 23 and the inlet element 17 by the voltage source 24 to establish an electrical current through the product within the crystallization vessel 14. Preferably, the current is less than about 10 A. To promote as homogeneous as possible distribution of the crystallization nuclei within the product, radial movement of the product within the crystallization vessel 14 is created generating a magnetic field within the interior of the crystallization vessel 14 by the magnetic coil 27.

Once the desired amounts of melt and alloy have been introduced into the crystallization vessel 14, the electric current generated between the electrode 23 and the melt inlet element 17 may be temporarily interrupted. Thereafter an electrical current is established therebetween that preferably has a voltage between about 150 V and 400 V, so that an arc is ignited between the electrode and the product, the arc preferably having a current of up to about 1300 A. To prevent a directional orientation of the crystallization nuclei within the product, the magnetic field generated by the magnetic coil 27 is adjusted accordingly and, for example, is continuously increased in the direction of the fill.

After the product has been prepared in this manner, the piston 21 is lowered, so that the product flows out via the guide cylinder 22 and the product outlet port for further processing. The product prepared by the method disclosed herein is suitable for use with all known casting methods.

In another preferred embodiment, the electrode 23 is integrated into the piston 21.

Figure 2:
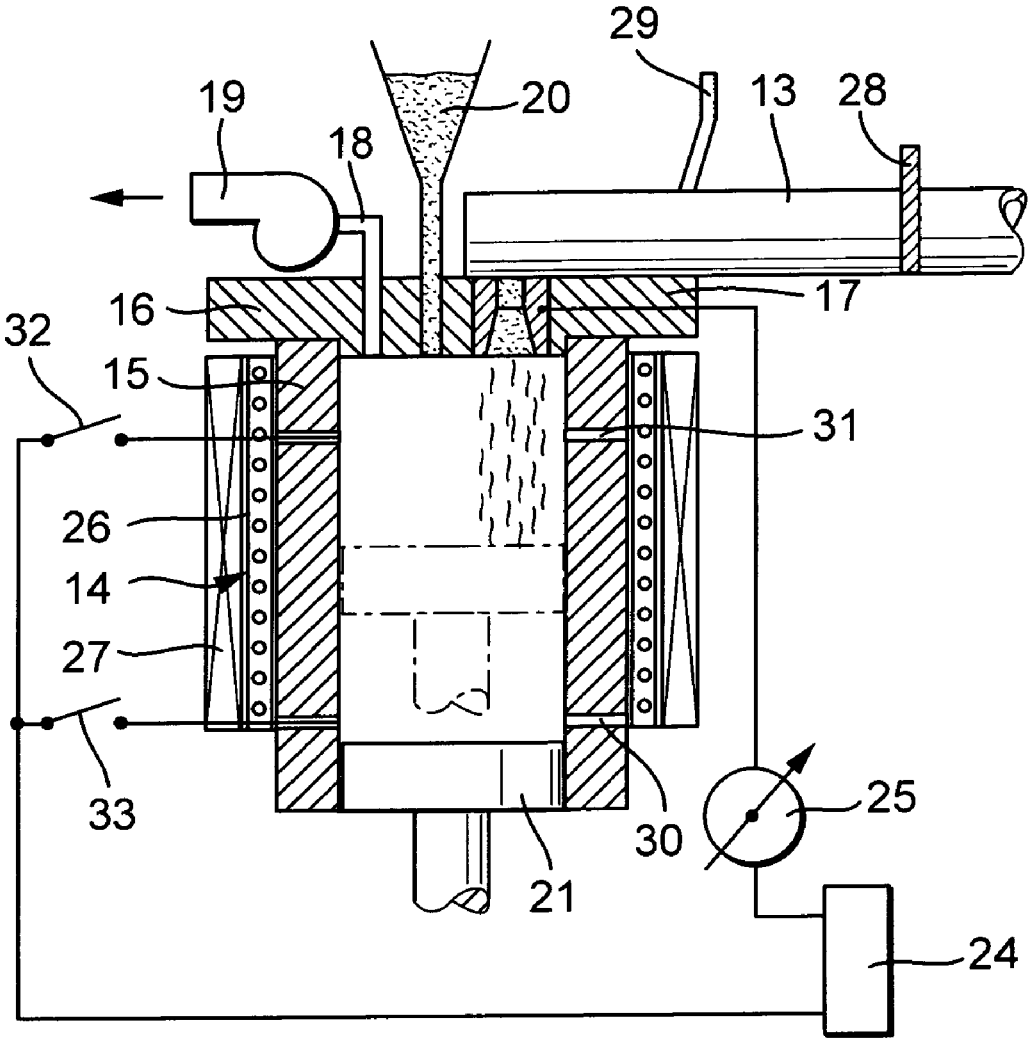
FIG. 2 is a cross-sectional view, of a schematic representation illustrating another embodiment of the present invention.

In another preferred embodiment, illustrated in FIG. 2, the voltage source 24 is connected to two electrodes 30 and 31 arranged, preferably, in a vertically spaced manner along a portion of the cylinder 15 of the crystallization vessel 14. The voltage source is also connected to a portion of the casting conduit 13. In this embodiment the piston 21 continuously moves downward while the melt and alloy are fed into the crystallization vessel, so that the electrodes 30 and 31 are sequentially employed and are switched on and off during the piston movement by means of switches 32 and 33.

Figure 3:
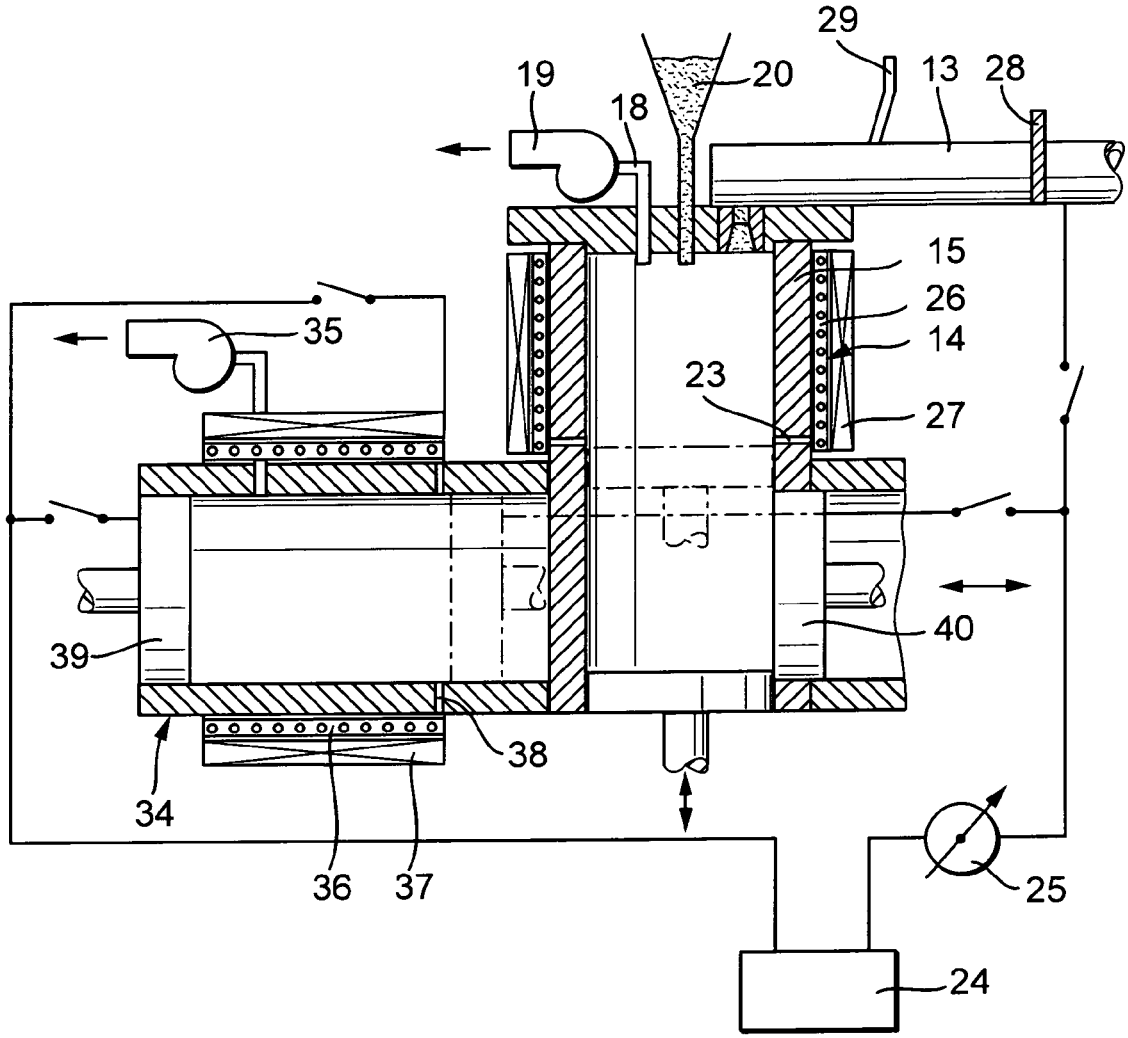
FIG. 3 is a cross-sectional view, of a schematic representation of another embodiment of the present invention illustrating the crystallization vessel with an added arrangement for receiving the processed melt.

In another preferred embodiment, as shown in FIG. 3, the product prepared in the crystallization vessel 14 is passed on to a storage or transport vessel 34, in which the product is maintained in its prepared state. The storage vessel 34 is provided with an exhaust device 35, so that a vacuum may be established therein. A heating device 36 and a magnetic coil 37 are arranged about the storage vessel 34. An electrode 38 is disposed within the storage vessel 34. Finally, two opposing walls 39, 40 of the storage vessel 34 are comprised of pistons that manipulate the product as it is stored therein. The storage vessel 34 may for forming the product therein into a more desired configuration for continued storage or casting.

Figure 4:
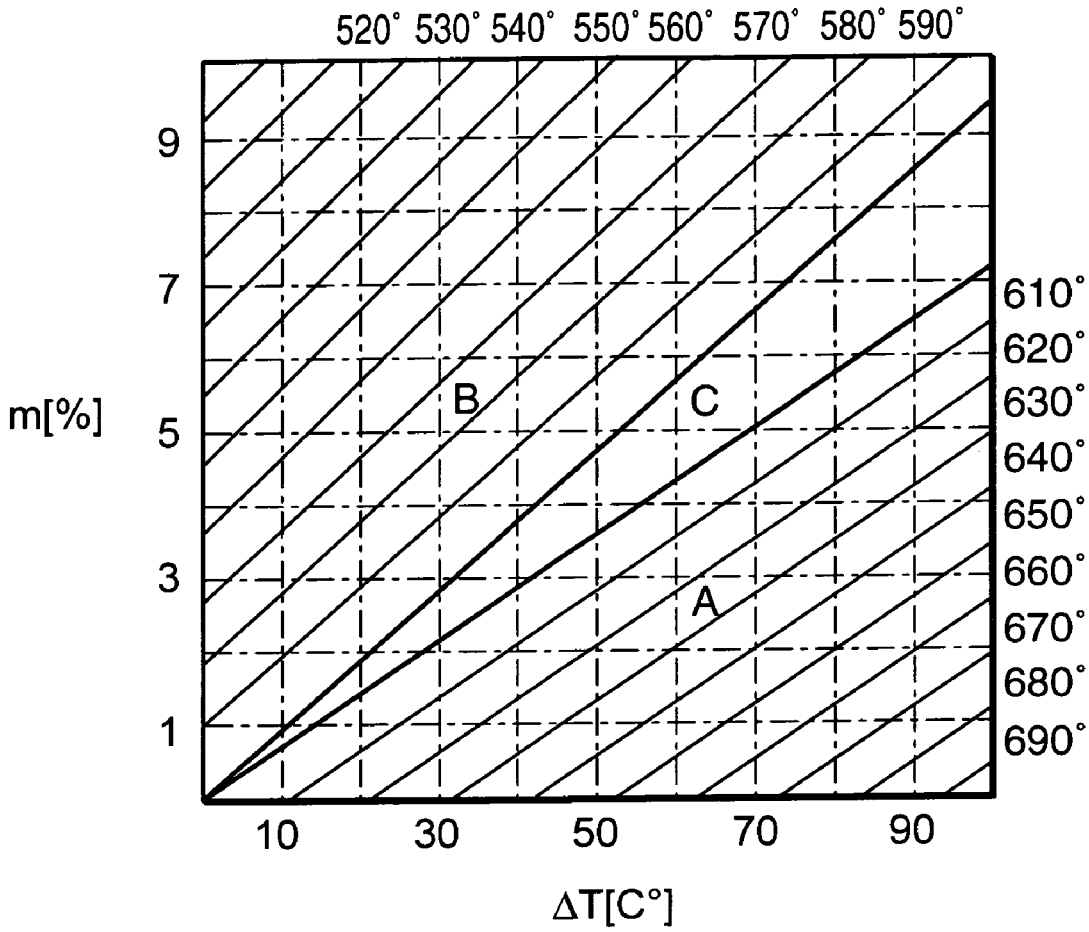
FIG. 4 represents a nomograph for predicting the thermokinetic progress of a product produced by the method of the present invention, specifically the alloy AISI9$Cu_3$.

The thermo-kinetic progress of a particular melt/alloy product can be predicted by means of a nomograph. For example, a nomograph for the melt/alloy product AISI9$Cu_3$ is represented in FIG. 4. The amount of pulverized alloy—added at a grain size of approximately 125 μm to approximately 400 μm—is entered as percentile amounts (see vertical axis). The temperature difference (Delta T) in C.° is the difference between the casting temperature and the liquefaction temperature of the alloy (see horizontal axis). If the percentage amount of pulverized alloy added lies within the nomograph range A, it only causes a reduction in the temperature of the product, i.e., the product is placed into a semi-solidified state without the pulverized particles forming crystallization nuclei. If the percentage amount of pulverized alloy is added so that the nomograph range B is reached, then the pulverized particles act as additional, unmelted crystallization nuclei. Finally, and most desired, if the percentage amount of added pulverized particles lies within the C range of the nomograph, then the two processes will take place side-by-side, i.e. a reduction of the product temperature and formation of crystallization nuclei because of unmelted particles. It is of course necessary to draw different nomographs for different alloys. It is understood that products of different melts and alloys will have their own nomographs.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for preparing a metal or metal-alloy product for a casting process wherein the product is manipulate-able in a semi-solidified state and in which crystallization nuclei are distributed uniformly therethrough, the product comprising a carrier material "melt" and an alloy, the method comprising the steps of:

a) feeding the melt into a crystallization vessel, the melt having a temperature greater than a liquefaction temperature of the alloy, wherein the feeding step includes introducing the melt into the crystallization vessel in the form of a stream flowing between at least two electrodes positioned at an inlet of the crystallization vessel, the electrodes being at spaced intervals around the inlet and supplied with electrical power;

b) introducing the alloy into the crystallization vessel simultaneously with the introduction of the melt, the alloy being in a pulverized form;

c) mixing the melt and the alloy in the crystallization vessel by applying electrical and magnetic forces thereto by establishing an electrical current between an electrode integral to the crystallization vessel and an inlet of the crystallization vessel, thereby establishing an electrical arc between the melt and the electrode;

d) maintaining the crystallization vessel at a temperature less than the liquefaction temperature of the alloy throughout the introduction and mixing steps; and (e) discharging the mixture of the alloy and the melt from the crystallization vessel in a semi-solidified state.

2. The method according to claim 1, wherein the alloy of the introducing step is in a powdered form.

3. The method according to claim 1, further comprising the steps:

a) liquefying the melt in a furnace before feeding the melt into the crystallization vessel, the furnace operating at a temperature greater than the liquefaction temperature of the alloy; and b) transporting the melt from the furnace to the crystallization vessel through a casting conduit.

4. The method according to claim 3, wherein the step of liquefying the melt includes maintaining the furnace at a vacuum.

5. The method according to claim 4, wherein the step of maintaining the furnace at a vacuum includes maintaining the furnace at a pressure of about 0.5 mbar to about 3 mbar.

6. The method according to claim 3, further comprising the step of regulating transport rate of the melt to the crystallization vessel.

7. The method according to claim 1, further comprising the step of maintaining the crystallization vessel at a vacuum.

8. The method according to claim 1, wherein the step of maintaining the crystallization vessel at a temperature less than the liquefaction temperature of the alloy includes pre-selecting the temperature of the crystallization vessel and heating the crystallization vessel to a pre-selected temperature by a heater arranged on an exterior of the crystallization vessel.

9. The method according the claim 1, wherein the step of maintaining the crystallization vessel at a temperature less than the liquefaction temperature of the alloy includes maintaining the temperature between about 3% and about 50% lower than the liquefaction temperature of the alloy.

10. The method according to claim 1, wherein the mixing step includes establishing a magnetic field within the crystallization vessel using a magnetic coil arranged on an exterior of the crystallization vessel.

11. The method according to claim 3, wherein the feeding step includes flowing the melt into the crystallization vessel by maintaining the crystallization vessel at a lower pressure than the furnace, thereby creating a suction between the crystallization vessel and the furnace that acts upon the melt.

12. The method according to claim 1, wherein the feeding step includes supplying a protective gas to the melt.

13. The method according to claim 12, wherein the supplying step involves using argon as the protective gas.

14. The method according to claim 1, wherein the feeding and introducing steps include flowing the melt and dispensing the alloy into the crystallization vessel by maintaining the crystallization vessel at a lower pressure than sources of the melt and the alloy.

* * * * *